US007673941B2

(12) United States Patent
King et al.

(10) Patent No.: US 7,673,941 B2
(45) Date of Patent: Mar. 9, 2010

(54) DELAYED GAS SPRING CHAIR

(75) Inventors: Robert King, New York, NY (US); Thomas Latone, Quakertown, PA (US)

(73) Assignee: Humanscale Corporation, New York, NY (US)

( * ) Notice: Subject to any disclaimer, the term of this patent is extended or adjusted under 35 U.S.C. 154(b) by 0 days.

(21) Appl. No.: 12/185,522

(22) Filed: Aug. 4, 2008

(65) Prior Publication Data

US 2008/0284218 A1 Nov. 20, 2008

Related U.S. Application Data

(62) Division of application No. 11/286,689, filed on Nov. 23, 2005, now abandoned.

(60) Provisional application No. 60/630,960, filed on Nov. 24, 2004.

(51) Int. Cl.
*A47C 1/00* (2006.01)

(52) U.S. Cl. ..... 297/344.19; 248/631

(58) Field of Classification Search ..... 297/344.19; 248/157, 631

See application file for complete search history.

(56) References Cited

U.S. PATENT DOCUMENTS

| | | | | |
|---|---|---|---|---|
| 2,645,272 | A | 7/1953 | Caramelli | |
| 3,273,786 | A * | 9/1966 | Newton | 417/494 |
| 3,845,690 | A * | 11/1974 | Ziegler | 91/35 |
| 4,061,295 | A * | 12/1977 | Somm | 244/104 FP |
| 4,397,440 | A | 8/1983 | Hall et al. | |
| 5,078,351 | A | 1/1992 | Gualtieri | |
| 5,588,641 | A * | 12/1996 | Sand | 267/119 |
| 5,806,828 | A | 9/1998 | Rothe et al. | |
| 5,823,513 | A | 10/1998 | Stenquist | |
| 5,921,628 | A | 7/1999 | Glockl | |
| 5,964,454 | A | 10/1999 | Volpel | |
| 6,170,809 | B1 | 1/2001 | Cotter | |
| 6,203,107 | B1 | 3/2001 | Jonsson | |
| 6,315,262 | B1 | 11/2001 | Hur | |
| 2006/0131942 | A1 | 6/2006 | King et al. | |

FOREIGN PATENT DOCUMENTS

| | | |
|---|---|---|
| EP | 0891727 A2 | 1/1999 |
| GB | 2148448 A | 5/1985 |
| WO | 2006042855 A3 | 6/2006 |

OTHER PUBLICATIONS

PCT/US05/042855, filed Nov. 23, 2005, Delayed Gas Spring Chair, Humanscale Corporation, written opinion issued Jul. 11, 2007.

* cited by examiner

*Primary Examiner*—Sarah B McPartlin
(74) *Attorney, Agent, or Firm*—Jones, Walker, Waechter, Poitevent, Carrere & Denegre, L.L.P.

(57) ABSTRACT

A gas spring adapted for automatically re-adjusting to a predetermined position, the gas spring incorporating a delay mechanism so that the automatic re-adjustment is delayed by a predetermined amount of time, and articles incorporating such a delay gas spring, such as a height adjustable chair. In one embodiment, the delay mechanism comprises a delay valve.

7 Claims, 6 Drawing Sheets

DELAYED GAS SPRING CHAIR

CROSS-REFERENCE TO RELATED APPLICATION

This application is a divisional application for patent claiming the benefit of the earlier filed non-provisional application for patent Ser. No. 11/286,689 filed on Nov. 23, 2005 and incorporated herein by reference, which claims the benefit of provisional application for patent Ser. No. 60/630,960 filed on Nov. 24, 2004 and incorporated herein by reference.

FIELD OF THE INVENTION

The present invention relates to gas springs and apparatuses, such as chairs, comprising gas springs. More particularly, the invention provides a gas spring capable of automatically re-adjusting to a predetermined position after a predetermined interval. The invention further provides height adjustable chairs using such a gas spring.

BACKGROUND OF THE INVENTION

Many existing chairs have vertical height adjustment mechanisms that include vertically extendable gas springs. Typically, the gas spring includes an actuator that extends above the gas spring into an area under a chair seat, and the seat includes a lever that can be manipulated by a seated user to unlock the gas spring. Upon release, the gas spring biases the seat upwardly. Alternatively, the seated user can, after unlocking the release button, press downwardly on the chair (such as by applying their bodyweight) to overcome the bias of the gas spring to force the seat downwardly. Once the desired vertical positioning has been achieved, the user can cease actuation of the lever, thus locking the gas spring (and the seat) at the desired height.

Vertically adjustable chairs are limited as they generally remain at the last height to which the chair was purposefully adjusted. For example, if the chair was last adjusted by a user that was shorter than average, the chair would remain at a height that is lower than a height comfortable for the average user. Likewise, if the chair was last adjusted by a user that was taller than average, the chair would remain at a height that is higher than a height comfortable for the average user. Such an effect is most readily observed in a conference room having a plurality of vertically adjustable chairs where the chairs are noticeably positioned at a plurality of heights. Such a plurality of heights is generally undesirable for a number of reasons. For example, this non-uniformity of heights can be aesthetically unappealing to many viewers. Further, it can be inconvenient for a number of different users to be required to constantly adjust the height of a chair. A chair designed to be at a vertical height to be comfortable for an average user (e.g., an individual having a height in a range determined to be an average adult height) could eliminate the need for many height adjustments; however, such a chair would fail to offer the benefit of adjustability necessary for users of non-average height.

The simplest solution to the plurality of heights among vertically adjustable chairs is to have the chair return to a predetermined height when the user removes his or her weight from the chair. That solution, however, creates its own disadvantages. If a chair user gets up momentarily (for example, to greet someone entering the room, or to retrieve an item from the other side of the room), the chair would return to its predetermined height, notwithstanding the user's intent to return to the chair shortly. Consequently, the user would be required to readjust the chair each time the user returns to the chair, even if having only risen momentarily.

Such an immediate return to a predetermined height can present further undesirable effects as well. For example, if the chairs were to return to their predetermined height as soon as the user gets up, on occasion, if many chair users in a single room were to arise, all of the chairs in a room may readjust their heights at the same time. This simultaneous readjustment could be a substantial distraction. Still further, immediate readjustment of the chair height could be a safety problem. For instance, if a user merely readjusted his or her weight, such as only partially arising to reach for an object, the chair height could readjust inopportunely, causing the user to fall.

In light of the above, it is desired to have a vertically adjustable chair that re-adjusts to its predetermined height sometime after the user leaves the chair. The present invention achieves this goal.

SUMMARY OF THE INVENTION

The present invention provides a height adjustable chair capable of automatically re-adjusting to a predetermined height after a predetermined interval. Such a chair is made possible in the present invention through inclusion of a gas spring comprising a delay mechanism. The delay mechanism is associated with the gas spring such that when a downward force is applied to the gas spring, the delay mechanism is set. Once the downward force is removed from the gas spring, the delay mechanism is released, or actuated, and the gas spring is subsequently re-adjusted to the predetermined position after the predetermined interval. The delay mechanism is particularly useful in that it can be calibrated to provide a delayed re-adjustment across a range of time. Accordingly, the delay mechanism can be calibrated to delay the re-adjustment for a relatively short time period, a relatively long time period, or any length of time in between. Furthermore, the delay mechanism can be calibrated to provide a delay that is consistent with each use or that is random. For example, in one embodiment of the invention, the delay mechanism delays the re-adjustment of the gas spring to the predetermined position for a time of about 5 minutes to about 30 minutes. Of course, it is understood that, if desirable, the delay time could be shorter, such as about 1 minute, or could be longer, such as up to about 2 hours. In one embodiment, the delay time is in the range of 5 minutes to about 60 minutes.

While the gas spring comprising the delay mechanism is particularly useful in a seating apparatus, such as an office chair, the present invention also encompasses additional uses for the inventive gas spring. For example, the delayed gas spring of the invention could be incorporated into further pieces of furniture, as well as equipment, such as office equipment. Non-limiting examples of further uses for the delayed return gas spring according to the invention include support devices, such as monitor arms and laptop holders, seating apparatuses, such as stools, and mobile storage or work units, such as carts. Of course, one of skill in the art armed with the present disclosure may envision further uses for the delay return gas spring of the invention, all of which are intended to be encompassed by the present invention.

In one embodiment, the invention provides a height adjustable chair. Preferably, the chair is manually adjustable by a user over a defined range of heights and is automatically re-adjustable to a predetermined position after a predetermined interval. According to this embodiment, there is provided a height adjustable chair comprising a gas spring that is manually adjustable between a fully extended position and a fully retracted position. The chair further comprises a delay mechanism associated with the gas spring. Preferably, the delay mechanism is adapted for causing the gas spring to automatically re-adjust to a predetermined position after a predetermined interval.

In this embodiment of the invention, the chair can include further chair components as would make the chair useful in various settings. For example, in one embodiment, the chair further comprises a pedestal attached to a lower end of the gas spring and a seat attached to an upper end of the gas spring. The pedestal can further comprise a plurality of casters. Moreover, the chair can comprise further components, such as a backrest, chair arms, and a headrest. The chair can also comprise additional components related to the gas spring. For example, the gas spring can include a release button that is operably moveable between a locked position, wherein the gas spring is locked and non-extendable, and an actuated position, wherein the gas spring is released and extendable (or retractable). The chair can also comprise an actuator constructed to selectively move the release button from the locked position to the actuated position.

The height adjustable chair of the invention preferably comprises a gas spring that momentarily dwells in its retracted (or extended) condition long enough for the drive mechanism to pass through the neutral zone and the drive gear teeth to re-engage the follower gear teeth before the gas spring load is transmitted through the dies to the press drive mechanism and gears.

In one embodiment, there is provided a gas spring comprising a casing having a first end and a second end, a piston rod axially disposed in the casing and protruding from the first end of the casing, a first piston attached to the piston rod and being slidably moveable within the casing between the first end of the casing and the second end of the casing, and a second piston slidably moveable within the casing between the first piston and the second end of the casing. The gas spring may further comprise a first fluid chamber disposed between the first end of the casing and the first piston and a second fluid chamber disposed between the first piston and the second piston. The first and second fluid chambers house a fluid, preferably an incompressible fluid. Still further, the gas spring may comprise a gas chamber disposed between the second piston and the second end of the casing. An incompressible gas is preferably housed within this gas chamber.

In one particularly preferred embodiment, the delay mechanism associated with the gas spring comprises a delay valve. The delay valve and a check valve are disposed within the piston that is situated between the first and second fluid chambers, the first piston according to this embodiment.

As force is applied to the piston rod in this embodiment, the first piston retracts toward the second end of the casing causing an increase in the fluid pressure in the second fluid chamber. The increased fluid pressure causes the check valve to open, and some fluid is allowed to pass from the second fluid chamber through the check valve into the first fluid chamber. The passage of fluid through the check valve is insufficient to maintain a constant total fluid chamber volume. Accordingly, the increased fluid pressure in the second fluid chamber causes the second piston to retract, thereby compressing the gas in the gas chamber. When the force is removed from the gas spring (particularly from the piston rod and the first piston), the compressed gas applies a force to the second piston, which in turn causes a higher fluid pressure in the first fluid chamber. This pressure is transferred to the first piston, and ultimately to the fluid in the first fluid chamber. The delay valve blocks fluid flow from the first fluid chamber back to the second fluid chamber for a predetermined amount of time, thereby causing the first piston to dwell in the retracted position. When the delay valve opens, fluid flows to the second fluid chamber, which in turn allows the first piston and the piston rod to move back to their extended position, or another predetermined position.

According to another embodiment of the invention, the delay mechanism comprises a timer. Preferably, the timer is adapted for being activated by the removal of a downward force from the gas spring. Once activated, the timer counts a time period that is calculated as the time from activation of the timer to the re-adjustment of the gas spring to the predetermined position. The time can be predetermined or random; however, if the time is random, the random time is preferably within a predetermined range. The timer in this embodiment of the invention can be an electronic timer or a mechanical timer. When an electronic timer is used, the timer can be battery powered or can be connected to an alternate power source. One example of a mechanical timer useful according to the invention is a cam.

The invention also encompasses an automatically re-adjustable gas spring that incorporates further automated components. For example, the gas spring could comprise computerized elements.

Preferentially, the delay mechanism of this embodiment further comprises a gas spring release. Accordingly, once the timer has counted the time period specified for the delay, the gas spring release is activated and the gas spring re-adjusts to its predetermined position. Further, optional components may also be included with the timer. For example, the delay valve as described above could be combined with the timer.

As noted above, once the timer is activated by removal of the downward force from the gas spring, the time count begins. Preferably, the timer is capable of being reset by reapplication of the downward force prior to lapse of the calculated time period. For example, when the gas spring is incorporated into a chair, according to the invention, when a user rises from the chair, thereby activating the timer, if the user (or another user) sits in the chair prior to lapse of the calculated time period, the timer is reset.

In yet another embodiment of the invention, the delay mechanism associated with the gas spring comprises a lever assembly. Preferably, the lever comprises a lever moveable between a locked position, where the gas spring maintains its position, and an actuated position, where the gas spring automatically re-adjusts to a predetermined position. The lever is adapted to be release from the locked position by removal of a downward force on the gas spring, such as a user rising from a chair incorporating the gas spring with the lever assembly. Once released from the locked position, the lever travels to the actuated position, where the lever actuates re-adjustment of the gas spring to the predetermined position. The lever in the actuated position may interact with another component, such as a gas spring release.

The delay mechanism in this embodiment of the invention further comprises one or more components for controlling the time required for the lever to move from the locked position to the actuated position. For example, the delay mechanism may further comprise a friction inducing component, one or more springs, or combinations thereof.

In still another embodiment of the invention, the delay mechanism comprises an actuator adapted to be engaged by removal of a downward force on the gas spring. In this embodiment, the delay mechanism further comprises a bleed valve adapted to be opened by the engagement of the actuator. Preferably, the bleed valve is formed to allow a gradual transfer of the fluid in the gas spring, such as between a first fluid chamber and a second fluid chamber. In one particular embodiment, the rate of the transfer of the fluid through the bleed valve determines the time required for the gas spring to re-adjust to the predetermined position.

As described above, the present invention provides an automatically re-adjustable gas spring. In particular, the invention comprises a gas spring and a delay mechanism associated with the gas spring. The delay mechanism can take on the various embodiments described, as well as alternative embodiments that could readily be envisioned in light of the present disclosure. The invention also provides various mechanisms and devices incorporating such a gas spring with the associated delay mechanism. For example, in one preferred embodiment, there is provided a height adjustable chair. Further height adjustable furniture and equipment are also encompassed by the present invention, as described herein.

BRIEF DESCRIPTION OF THE DRAWINGS

Figure 1:
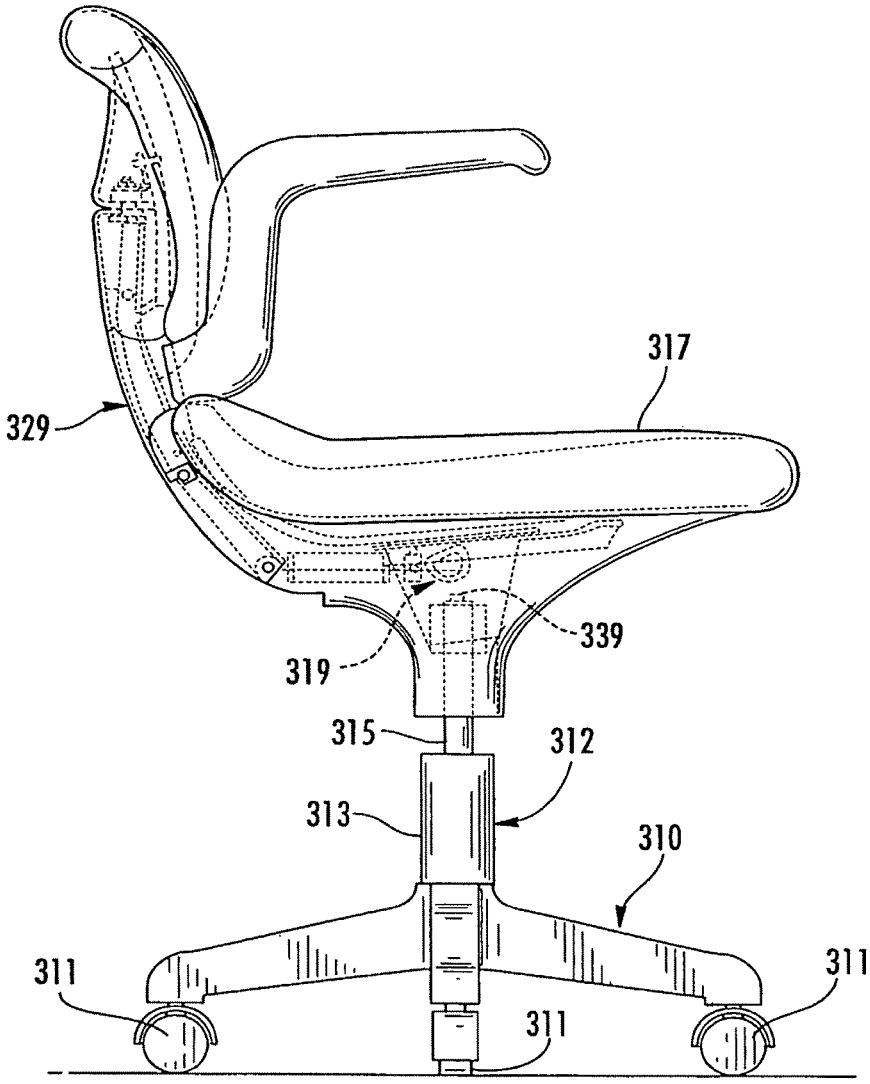
Figure 2:
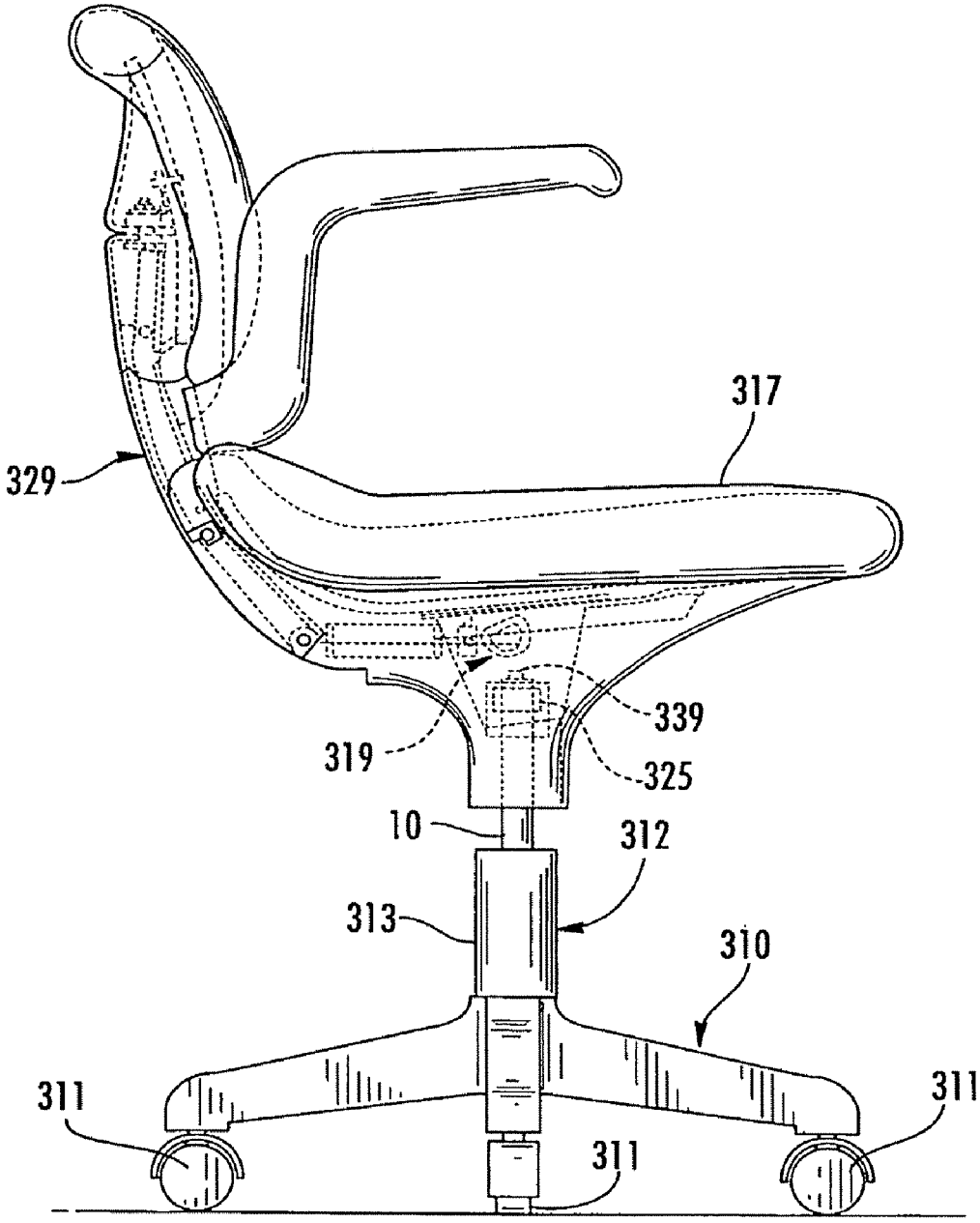
Figure 5:
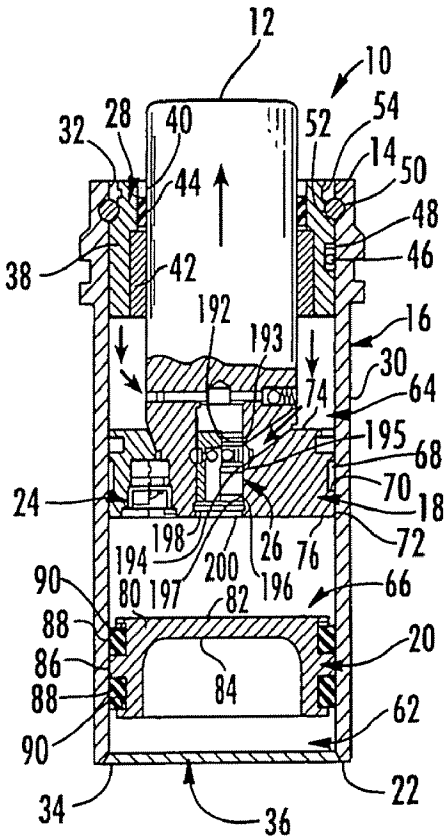
Figure 4:
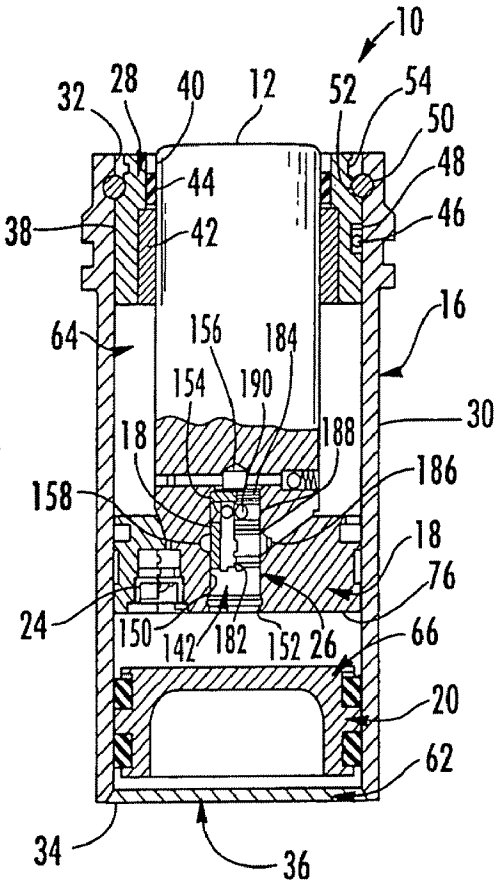
Figure 3:
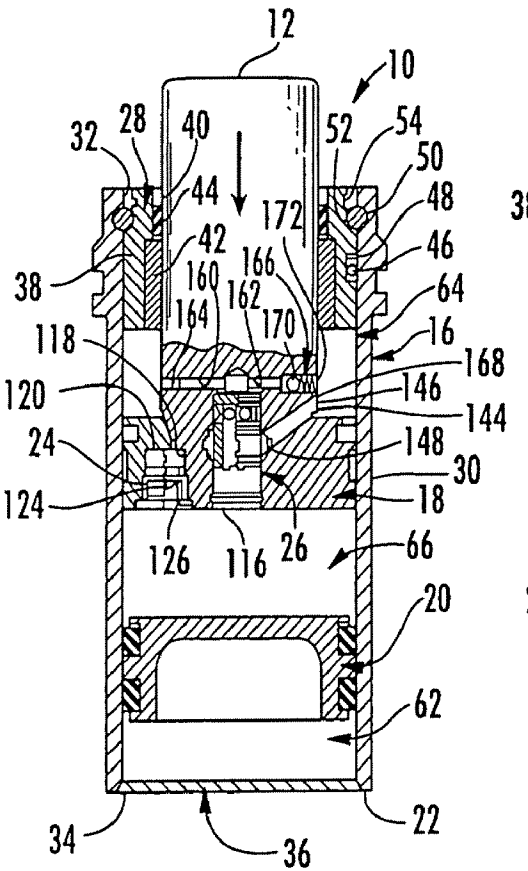
Figure 6:
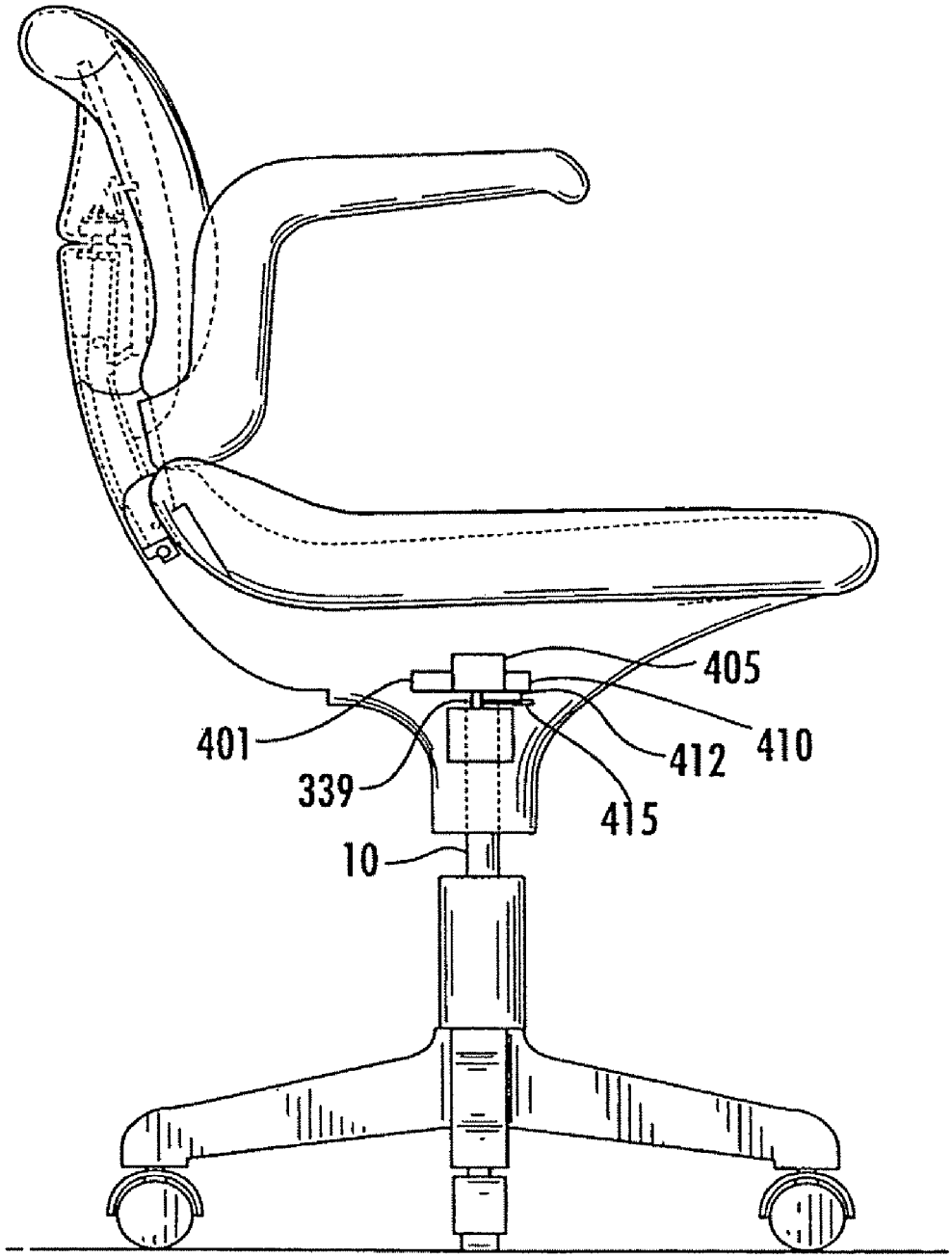
Figure 7:
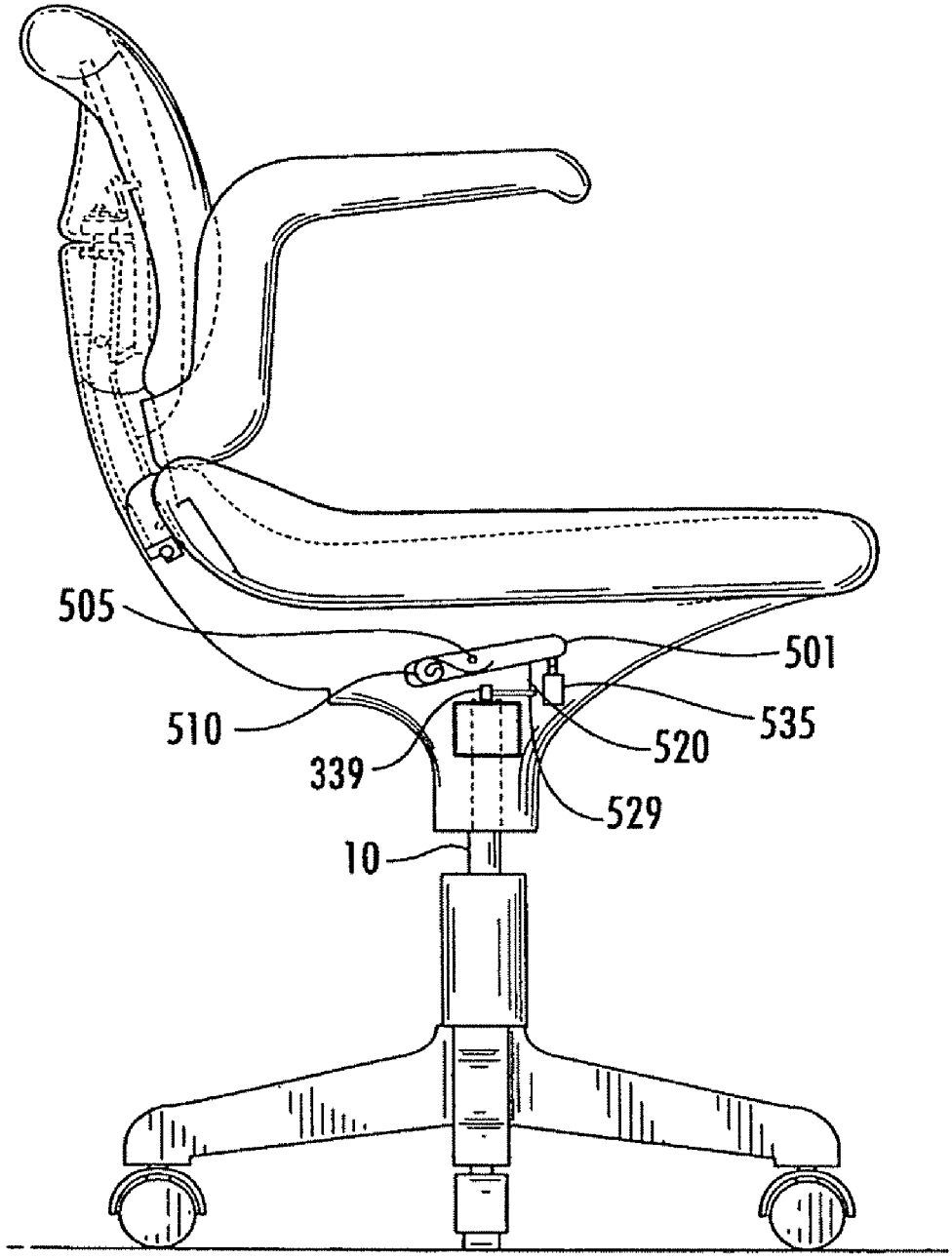
Figure 8:
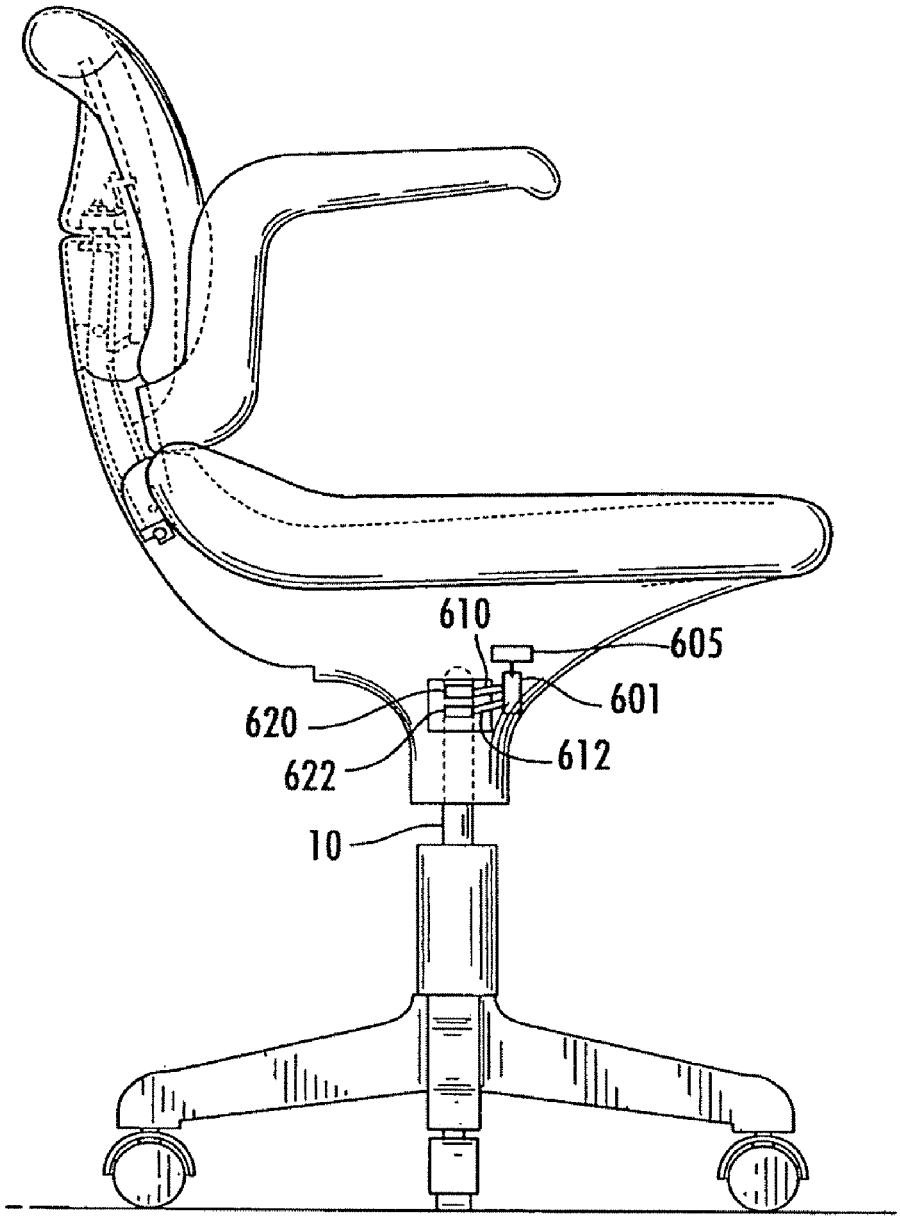

Having thus described the present invention in general terms, reference will now be made to the accompanying drawings, which are not necessarily drawn to scale, and wherein:

FIG. 1 provides a side elevational view of a conventional height adjustable chair incorporating a gas spring;

FIG. 2 provides a side elevational view of a height adjustable chair according to one embodiment of the invention comprising a gas spring and a delay valve according to the invention;

FIG. 3 is a fragmentary sectional view of a gas spring comprising a delay valve according to the invention wherein the first piston in the gas spring is in a downstroke;

FIG. 4 is a fragmentary sectional view of a gas spring comprising a delay valve according to the invention as shown in FIG. 3, wherein the first piston is in a fully retracted position;

FIG. 5 is a fragmentary sectional view of a gas spring comprising a delay valve according to the invention as shown in FIG. 3, wherein the first piston is in a return stroke FIG. 6 provides a side elevational view of a height adjustable chair according to one embodiment of the invention comprising a gas spring and a timer according to the invention;

FIG. 7 provides a side elevational view of a height adjustable chair according to one embodiment of the invention comprising a gas spring and a release lever according to the invention; and FIG. 8 provides a side elevational view of a height adjustable chair according to one embodiment of the invention comprising a gas spring and a bleed valve assembly according to the invention.

DETAILED DESCRIPTION OF THE INVENTION

The present inventions now will be described more fully hereinafter with reference to specific embodiments of the invention. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present invention provides an automatically re-adjustable gas spring and furniture and equipment incorporating such a gas spring. The automatically re-adjustable gas spring of the invention is characterized in that the gas spring comprises a delay mechanism capable of responding to a stimulus to re-adjust the gas spring to a predetermined position after passage of a predetermined amount of time. In some embodiments of the invention, the automatically re-adjustable gas spring is particularly designed and made to incorporate the delay mechanism. In other embodiments of the invention, the automatically re-adjustable gas spring can be prepared through modification of a conventional gas spring to incorporate the delay mechanism.

The automatically re-adjustable gas spring of the invention is particularly useful in that it can be incorporated into various types of furniture and equipment. The automatically re-adjustable gas spring can be incorporated into items that commonly allow for manual positional adjustment by a user, such as an office chair. The inventive gas spring can further be incorporated into other items that would benefit from having the capability of positional adjustment. Accordingly, while the automatically re-adjustable gas spring of the invention may be described herein in relation to a particular embodiment, such as an office chair, it is understood that the invention is not limited thereby. Rather, the automatically re-adjustable gas spring of the invention can take on various embodiments and can be incorporated into various types of furniture and equipment, such as would be apparent to the skilled artisan having the benefit of the present disclosure.

In one embodiment, the present invention is directed to a height adjustable chair. FIG. 1 shows a conventional height adjustable chair having a pedestal 312 with a substantially vertical elongate tubular casing 313 having an upper end and a lower end. The chair has a plurality of arms 310 radiating out from the lower end of the tubular casing 313 and a plurality of castors 311 mounted at the end of the radiating arms 310. Projecting upward from the pedestal 312 is a gas spring 315. A seat 317 and a seat back 329 are mounted on top of the gas spring 315. As also shown in FIG. 1, the conventional height adjustable chair includes a release button 339, which is activated by a lever mechanism 319.

As shown in FIG. 2, a height adjustable chair according to the present invention can include many of the features of a conventional height adjustable chair, such as shown in FIG. 1. Specifically, as shown in FIG. 2, the height adjustable chair of the present invention comprises, in one embodiment, a pedestal 312 with a substantially vertical elongate tubular casing 313 having an upper end and a lower end. The chair has a plurality of arms 310 radiating out from the lower end of the tubular casing 313 and a plurality of castors 311 mounted at the end of the radiating arms 310. As also shown in the embodiment of FIG. 2, the height adjustable chair further comprises a gas spring 10 projecting upward from the pedestal 312. A seat 317 and a seat back 329 are mounted on top of the gas spring 10, and the chair also includes a release button 339, which is activated by a lever mechanism 319.

The inventive height adjustable chair illustrated in FIG. 2 particularly differs from a conventional height adjustable chair in that the chair according to the invention further comprises a delay mechanism. In the specific embodiment of FIG. 2, the delay mechanism is a delay valve 25. In FIG. 2, the delay valve 25 is located near the upper portion of the gas spring 10; however the invention is not so limited. For example, the delay valve 25 can be located near the bottom of the gas spring 10, such as within the tubular casing 313.

FIGS. 3-5 provide a detailed view of a gas spring including a delay valve according to one embodiment of the invention. A same or similar gas spring arrangement as shown in the Figures, and described hereinafter, can be used according to further embodiments of the invention comprising a different delay mechanism.

In a preferred embodiment, the gas spring 10 comprises a casing 16, which is formed of an elongate tube 30 having a first tube end 32 and a second tube end 34. In this embodiment, the first tube end 32 is open, and the second tube end 34 is closed having an end cap 36 fitted into and welded to the opening of the second tube and 34 to seal it off. Other methods for closing an open end of the tube 30 are also encompassed by the invention. For example, the end cap 36 may be formed integrally with the tube 30.

The gas spring 10 has a piston rod 12 axially disposed and protruding from the first tube end 32 of the casing 16. A bearing and seal assembly 28 is received within the opening at the first tube end 32 and is fitted to seal off the first tube end 32 and provide a seal around the piston rod 12. The bearing and seal assembly 28 is received within the first tube end 32 and has an annular housing 38 defining a central rod opening 40 through which the piston rod 12 extends. The piston rod 12 is guided for axial reciprocation by a rod bearing 42 press fit into the housing 38. The rod bearing 42 is preferably formed of sintered bronze as a ring shaped sleeve and impregnated with lubricant, although other suitable arrangements could also be used. Also disposed within the rod opening 40 is a rod seal 44 carried by the housing 38 and providing a fluid seal between them. A fluid seal is provided between the casing 16 and housing 38 by an O-ring 46 received in an annular ring groove 48 in the housing 38. To retain the bearing and seal assembly 28 within the first tube end 32, a split ring 50 is received in an annular groove 52 between them. A dust cap (not shown) can be received in a groove 54 in the casing 16.

The piston rod 12 is connected to a first piston 18, which is slidably moveable within the casing 16 between the first tube end 32 and the second tube end 34 of the casing 16. The first piston 18, in one embodiment, has a top surface 74 and a bottom surface 76, both of which are essentially flat. A second piston 20 is disposed within the casing 16 between the first piston 18 and the second tube end 34 of the casing 16, also being slidably moveable therein.

Preferably, a fluid seal is formed between the casing 16 and the first piston 18. In one embodiment, a wiper seal 68 is disposed in an annular groove 70 in the cylindrical surface 72 of the first piston 18. Likewise, a fluid seal is preferentially formed between the casing 16 and the second piston 20. In one embodiment, the second piston 20 has a cup shaped cylindrical body 80 with an essentially flat top surface 82 and a bottom cupped compression surface 84. To form a fluid seal, the outer cylindrical surface 86 of the cup shaped cylindrical body 80 has a pair of seals 88 received in two recessed annular grooves 90.

A first fluid chamber 64 is formed by the space between the first tube end 32 of the casing 16 sealed around the piston rod 12 with the bearing and seal assembly 28 and the first piston 18, sealed with the wiper seal 68. A second fluid chamber 66 is formed by the space between the first piston 18 and second piston 20, sealed by the pair of seals 88 in the recessed annular grooves 90. A gas chamber 62 is formed by the space between the second piston 20 and the second tube end 34 with the end cap 36.

A compressible gas is sealed within the gas chamber 62. In one embodiment, the compressible gas is nitrogen gas, although other gases, particularly inert gases, could also be used. Preferably, the gas is contained at a minimum pressure to facilitate proper function of the gas spring. For example, in one embodiment, the gas is contained at a minimum pressure of about 2,000 psi. The gas is further compressed when the second piston 20 moves toward the second tube end 34 of the casing 16.

A fluid is held within the first fluid chamber 64 and the second fluid chamber 66. Preferably, the fluid is an essentially incompressible fluid. The fluid used in the fluid chambers preferentially has a suitable viscosity and application temperature range for use in a gas spring. In particular, the fluid should be suitable for use up to a temperature of at least about 200° F. In one particular embodiment, the fluid is a hydraulic oil.

As shown in FIGS. 3-5, the delay mechanism of the invention comprises a delay valve. In this embodiment, the delay valve assembly 26 is disposed within the first piston 18. Further, according to this embodiment, the gas spring 10 further comprises a check valve assembly 24, which is also preferably disposed within the first piston 18.

In a particular embodiment, the check valve 24 comprises a housing 116 press fit into a bore 118 in the first piston 18. The check valve 24 communicates with the first fluid chamber 64 through a check valve channel 120 in the first piston 18. A moveable valve element 124 bears on a complementary seat 126 (the closed position) to prevent the flow of fluid from the first chamber 64 to the second chamber 66 and unseats (the opened position) to permit reverse fluid flow from the second fluid chamber 66 to the first fluid chamber 64.

In the embodiment of FIGS. 3-5, the delay valve assembly 26 is disposed within a valve chamber 142 in the first piston 18. The delay valve assembly 26 is particularly designed to permit controlled flow of fluid from the first fluid chamber 64 to the second fluid chamber 66. The delay valve comprises a valve chamber 142 formed of a cylindrical counterbore 150 in the first piston 18. The valve chamber 142 opens axially into the bottom surface 76 of the first piston 18, thereby forming an open chamber end 152 in fluid communication with the second fluid chamber 66.

The valve chamber 142 is formed for communication with the first fluid chamber through a cylindrical delay valve channel 144 in the first piston 18. The cylindrical delay valve channel 144 opens into the first fluid chamber at a fluid inlet 146 and opens into the valve chamber 142 at a fluid outlet 148. In turn, the valve chamber 142 communicates with the second fluid chamber 66 at the open chamber end 152 allowing fluid to pass from the first fluid chamber 64 to the second fluid chamber 66 when the delay valve 26 is open. An annular groove 158 in the counter bore 150 is formed for communicating with the delay valve channel 144 through the fluid outlet 148 in the valve chamber 142 when the valve body 180 is properly aligned, as further described below.

The valve chamber 142 further comprises a closed chamber end 154 that is formed for communicating with an axial blind bore 156. The blind bore 156 communicates with the first fluid chamber 64 through a first passage 160 and a second passage 162 opposing one another through the piston rod 12. A metering orifice 164 is pressed into the first passage 160 for controllably regulating the rate of flow of fluid from the first fluid chamber 64 through the first passage and into the blind bore 156, and hence into the closed chamber end 154 of the valve chamber 142. A mini one-way check valve 166 is pressed into the second passage 162. The mini one-way check valve 166 is particularly useful for allowing fluid to be purged from the closed chamber end 154 while preventing reverse flow of fluid through the second passage 162. In one embodiment, the mini one-way check valve 166 comprises a ball valve 168, a valve seat 170, and a compression spring 172. The spring 172 applies sufficient force on the ball valve 168 so that it remains in abutment with the seat 170 until the fluid pressure within the blind bore 156 and the closed chamber end 154 sufficiently exceeds the fluid pressure in the first fluid chamber 64.

In a preferred embodiment, the delay valve 26 has a cup shaped cylindrical valve body 180 having an open valve body end 182 coinciding with the open chamber end 152 of the valve chamber 142 and a closed valve body end 184 coinciding with the closed chamber end 154 of the valve chamber 142. The outer surface of the valve body 180 preferentially comprises an essentially uniform cylindrical valve body section 186 adjacent the open valve body end 182 and a ported valve body section 188 adjacent the closed valve body end 184 of the valve body 180. The ported section 188 comprises a series of valve body holes 190 extending through the valve body 180 and spaced apart around the circumference of the valve body 180. The valve body holes 190 are useful for allowing fluid to pass through the valve body 180 into the hollow cupped portion of the valve body 180.

In the embodiment shown in FIG. 5, three annular valve body grooves 192, 194, 196 are vertically spaced apart along the valve body 180. Valve body groove 192 is positioned near the closed valve end 184, valve body groove 194 is positioned between the uniform valve body section 186 and the ported valve body section 188, and valve body groove 196 is positioned near the open valve body end 182. Each of the valve body grooves 192, 194, 196 retain an O-ring 193, 195, 197 for providing a seal between the valve body 180 and the valve chamber 142, thereby sealing the ported valve body section 188 from the uniform valve body section 186.

The valve body 180 is retained within the valve chamber 142 by a snap ring 198 removably received in an annular chamber groove 200 in the valve chamber 142 positioned near the open chamber end 152. When the valve body abuts the closed chamber end 154, the uniform valve body section 186 overlies the outlet 148 of the delay valve channel 144, thereby preventing fluid flow through the delay valve channel 144 into the hollow cupped portion of the valve body 180. When the valve body 180 abuts the snap ring 198, the ported valve body section 188 and the valve body holes 190 are aligned with the outlet 148 and the delay valve channel 144, thereby forming a fluid communication between the first fluid chamber 64 and the second fluid chamber 66, allowing fluid flow from the first fluid chamber 64 to flow through the delay valve channel 144 and the valve body holes 190 into the hollow cupped portion of the valve body 180, and into the second fluid chamber 66.

Further structure and advantages of a delay valve according to the invention can be made evident through description of the operation of a gas spring including a delay valve according to the invention. In operation, a gas spring has an external force applied to the piston rod 12, such as a user sitting in a chair according to the invention incorporating a gas spring. The function of the delay valve of the invention in connection with a gas spring is illustrated in FIGS. 3-5.

The downstroke of the piston rod 12 is shown in FIG. 3. As can be seen therein, downward movement of the first piston 18 causes an increase in fluid pressure in the second fluid chamber 66, particularly making the fluid pressure in the second fluid chamber 66 greater than the fluid pressure in the first fluid chamber 64. The higher fluid pressure forces fluid into the hollow, cupped portion of the delay valve body 180 causing the delay valve body 180 to move toward and bottom out at the closed chamber end 154 of the valve chamber 142. This forces any fluid within the closed chamber end 154 of the valve chamber 142 to be purged out of the valve chamber 142 through the second passage 162 and the mini check valve 166 into the first fluid chamber 164. The uniform valve body section 186 then overlies the fluid outlet 148 of the delay valve channel 144 thereby closing off fluid communication between the second fluid chamber 66 and the first fluid chamber 64 through the delay valve channel 144.

In addition to the above, the higher fluid pressure in the second fluid chamber 66 also causes the check valve assembly 24 to open allowing fluid to freely flow from the second fluid chamber 66 to the first fluid chamber 64 through the check valve channel 120. The rate of change of the volume space within the first fluid chamber 64 is always less than the rate of change of the volume space of the second fluid chamber 66. Accordingly, all of the fluid displaced in the second fluid chamber 66 by the downward force of the piston rod 12 and the first piston 18 can not be transferred from the second fluid chamber 66 to the first fluid chamber 64 through the check valve 24, which is opened as described above. The total volume of the first fluid chamber 64 and the second fluid chamber 66 remains constant while their relative volume changes as the fluid is transferred through the check valve 24. To maintain the constant total volume of the first fluid chamber 64 and the second fluid chamber 66, the second piston 20 is moved axially toward the second tube end 34 sealed with the tube end cap 36, thereby compressing the gas within the gas chamber 62.

When the first piston 18 has stopped moving toward the second tube end 34 of the gas spring and has not yet started to move toward the first tube end 32, the gas spring is in an equilibrium state. Such a state is illustrated in FIG. 4. As can be seen therein, this bottom stroke condition is achieved when the external force applied to the piston rod 12 is equivalent to the force applied by the compressed gas within the gas chamber 62. As the external force is removed from the piston rod 12, the force applied to the second piston 20 by the compressed gas within the gas chamber 62 creates a higher pressure condition in the first fluid chamber 64. The increased pressure in the first fluid chamber 64 forces closed the check valve 24, thereby preventing fluid from passing from the first fluid chamber 64 to the second fluid chamber 66 through the check valve 24. The higher pressure within the first fluid chamber 64 also forces the mini check valve 166 to close, thereby preventing fluid from passing through the second passage 162 and the blind bore 156 into the closed chamber end 154 of the valve chamber 142.

Since fluid from the first fluid chamber 64 is prevented from passing through the mini check valve 166 and into the closed chamber end 154 of the valve chamber 142, the delay valve body 180 remains bottomed against the closed chamber end 154 of the valve chamber 142. The uniform valve body section 186 of the delay valve body 180 also remains aligned with the delay valve channel 144, also preventing fluid from passing from the first fluid chamber 64 through the delay valve channel 144 and into the second fluid chamber 66. Given this alignment, in response to the increased pressure, fluid within the first fluid chamber 64 can only pass through the metering orifice 164 in the first passage 160 into the blind bore 156 and into the closed chamber end 154 of the valve chamber 142. As fluid gradually passes through the metering orifice 164 into the blind bore 156 and into the closed chamber end 154 of the valve chamber 142, the valve body 180 is gradually forced to move toward open chamber end 152, where the valve body 180 eventually bottoms against the snap ring 198.

As previously noted, the fluid contained within the first fluid chamber 64 and the second fluid chamber 66 is preferably essentially incompressible. Accordingly, the piston rod 12 and the first piston 18 dwell in the bottom stroke position, as shown in FIG. 4, until the valve body holes 190 are aligned with the fluid outlet 148 of the delay valve channel 144.

Preferably, the amount of time during which the first piston 18 and the piston rod 12 dwell in the bottom stroke position is controllable. According to a particular embodiment of the invention, the time is controlled by varying one or both of the flow characteristics of the metering orifice 164 and the fluid volume necessary to move the delay valve body 180 from the closed chamber end 154 of the valve chamber 142 into abutment with the snap ring 198. A metering orifice that allows relatively slow passage of fluid results in a gas spring with a relatively slow re-adjustment to a predetermined position. Alternatively, a metering orifice that allows relatively fast passage of fluid results in a gas spring with a relatively fast re-adjustment to a predetermined position. Preferably, the delay valve is designed to allow for use of a variety of metering devices of different fluid passage times. Therefore, a single delay valve could be prepared, and the gas spring incorporating the delay valve could be tailored to a preferred re-adjustment time by including a metering orifice having the desired design specifications.

The delay valve is preferentially designed to facilitate automatic re-adjustment to a predetermined position that is commensurate to the scope of use of the gas spring incorporating the delay valve. For example, in one embodiment, the invention provides a chair incorporating a gas spring with the delay valve. According to this embodiment, it is useful for the chair to automatically re-adjust to a predetermined height after a predetermined time once a user arises from the chair. The predetermined time can be, for example, as little as about 1 to 2 minutes, or up to about 1 to 2 hours. In a preferred embodiment, the predetermined time is about 5 minutes to about 60 minutes, more preferably about 5 minutes to about 45 minutes, still more preferably about 5 minutes to about 30 minutes.

Once the valve body holes 190 are aligned with the annular groove 158, fluid from the first fluid chamber 64 passing through the delay valve channel 144 into the annular groove 158, can then pass through the valve body holes 190, into the hollow, cupped portion of the delay valve body 180, through the open valve body end 182, through the open chamber end 152 of the valve chamber 142, and into the second fluid chamber 66. The first piston 18 and the piston rod 12 will then move through the return stroke, as shown in FIG. 5, to their fully extended positions, or to another predetermined position.

The delay valve assembly described above is representative of the various delay valve embodiments encompassed by the present invention, and the delay valve can undergo various alterations as appropriated to find use in the variety of furniture and equipment envisioned by the present invention. For example, the delay valve could be combined with one or more additional delay mechanisms also encompassed by the invention.

In another embodiment of the invention, the delay mechanism used with the gas spring comprises a timer. Preferably, the timer is adapted for being activated by the removal of a force from the gas spring. For example, when the gas spring and the timer comprise components of a chair, the timer is adapted for being activated by the removal of the weight of a user from the chair.

FIG. 6 illustrates a chair, according to one embodiment of the invention, wherein the delay mechanism comprises a timer. The chair, according to this embodiment, may incorporate many chair elements, as previously described. In particular, the chair includes a gas spring 10 that is adapted for being automatically readjusted to a predetermined position. The chair further comprises a sensor 401, a timer, 405, a controller 410, and a timer lever 415 that is moveably connected to the controller 410 with connection means 412.

The sensor 401 can comprise any means commonly recognized as being useful for sensing pressure changes or movement. For example, in one embodiment, the sensor is a pressure sensor. In another embodiment, the sensor is a light sensor.

As previously noted, the timer 405 can be an electronic timer, such as a digital counter, or a mechanical timer, such as a cam. Timer choice may be at least partially determined based upon the application of the delay gas spring. For example, in a chair embodiment, a mechanical timer may be particularly useful due to longevity and sturdiness. In other embodiment, however, such as a cart or a monitor arm, an electronic timer may be beneficial, particularly based upon the ability to interface with computerized components, thereby providing additional customization and control of the automatic readjustment provided by the gas spring.

The controller 410 can comprise any means readily recognizable by the skilled artisan as being useful for facilitating actuation of the lever 415 upon receiving appropriate stimulus from the timer 405. In operation, when a user sits on the chair, the sensor 401 sets the timer 405 with a first signal. When the user arises from the chair, the sensor 401 starts the timer with a second signal. Once the timer has counted down the appropriate time, it signals the controller, which facilitates actuation of the lever 415, which manually readjusts the gas spring 10 to the predetermined height. For example, the lever 415 may actuate the release button 339.

In yet another embodiment of the invention, the delay mechanism used with the gas spring comprises a release lever assembly. The lever assembly comprises a lever having a locked position and an actuated position. Preferably, the lever is adapted to be released from the locked position by removal of a force on the gas spring, such as a user arising from a chair incorporating the gas spring and the release lever.

FIG. 7 illustrates a chair, according to one embodiment of the invention, wherein the delay mechanism comprises a release lever assembly. The chair, according to this embodiment, may incorporate many chair elements, as previously described. In particular, the chair includes a gas spring 10 that is adapted for being automatically readjusted to a predetermined position. The chair further comprises a lever sensor 501, a release lever 529, and a speed controller 535.

In operation, when a user sits in the chair, the lever sensor 501 is set to the locked position (shown in FIG. 7). To facilitate the setting of the lever sensor 501 to the locked position, the chair may include further components not shown in the figure. When the user arises from the chair, the lever sensor 501 begins to pivot at pivot point 505. Such pivoting is facilitated by the spring bias 510 that functions to bias the rear portion of the lever sensor upward. Downward movement of the front portion of the lever sensor 501 translates into movement of the release lever 529 that is moveably connected to the lever sensor 501 with attachment means 520. Downward actuation of the release lever 529 causes the chair to automatically readjust to the predetermined position such as through actuation of the release button 339.

The amount of time between the user arising and the chair being readjusted to the predetermined height can be varied with the speed controller 535. The speed controller 535 is attached to the lever sensor 501 and varies the speed at which the front portion of the lever sensor 501 is allowed to move downward by the force applied by the spring bias 510. The speed controller 535 can take on various embodiments. For example, the speed controller may be a friction device or one or more springs. Further, in other embodiments, the speed controller 535 may be attached to the lever sensor 501 at locations different from that shown in FIG. 7. Alternately, the speed controlled 535 may be attached to the release lever 529.

In still another embodiment of the invention, the delay mechanism used with the gas spring comprises an actuator adapted to be engaged by removal of a downward force on the gas spring. The actuator further comprises a bleed valve adapted to be opened by engagement of the actuator. Preferably, the bleed valve is formed to allow a gradual transfer of a fluid between a first fluid chamber and a second fluid chamber in the gas spring. After a predetermined volume of fluid has been transferred through the bleed valve, the gas spring automatically re-adjusts to the predetermined position.

FIG. 8 illustrates a chair, according to one embodiment of the invention, wherein the delay mechanism comprises a bleed valve. The chair, according to this embodiment, may incorporate many chair elements, as previously described. In particular, the chair includes a gas spring 10 that is adapted for being automatically readjusted to a predetermined position. The chair further comprises a controller valve 601 and a sensor, 605. The controller valve 601 is in fluid communication with a portion of the gas spring 10 comprising a first fluid chamber 620 and a second fluid chamber 622. Said communication is through a first fluid channel 610 and a second fluid channel 612.

In operation, when a user arises from the chair, the sensor 605 recognizes the movement and opens the controller valve 601. The sensor 605 is but one embodiment of an actuator device adapted for being engaged by removal of a downward force on the gas spring (such as a user arising from the chair). The controller valve 601 allows for controlled movement of fluid from one of the fluid chambers to the other. For example, in one embodiment, when the user sits in the chair, the function of the gas spring leads to an increased fluid volume and/or pressure in the second fluid chamber 622. When the user arises and the sensor 605 opens the controller valve 601, fluid from the second fluid chamber moves into the second channel 612, through the controller valve 601, through the first fluid channel 610, and into the first fluid chamber 620. Preferentially, the gas spring 10 is formed such that once a predetermined volume of fluid has entered the first fluid chamber 620, the chair automatically readjusts to a predetermined position.

As would be understandable by the skilled artisan, a gas spring, such as embodied in the present invention, is subject to heavy loads and high fluid pressures (often in the range of 2,000 to 6,000 psi). Such pressures can easily translate in high operating temperatures for the gas spring. Preferably, the temperature of the gas spring should remain less than about 160° F. To prevent degradation of the fluid in the gas spring, the temperature within the cylinder should not exceed about 200° F. In order to control the operating temperature, a number of cooling techniques may be employed. For example, in one embodiment, cool water may be run through a coil wrapped around the cylinder. In another embodiment, a cool water jacket may be wrapped around the cylinder. In yet another embodiment, compressed air may be continuously or intermittently blown into the cylinder. Of course, other appropriate methods, as would be envisioned by the skilled artisan with the benefit of the present disclosure, are also encompassed by the invention.

Many modifications and other embodiments of the inventions set forth herein will come to mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A height adjustable chair comprising a gas spring being manually length adjustable between a fully extended position and a fully retracted position; and a delay mechanism associated with said gas spring, said delay mechanism being adapted for causing said gas spring to automatically readjust to a predetermined position after a predetermined interval, wherein said delay mechanism comprises a lever assembly having a lever movable between a locked position where said gas spring maintains its position and an actuated position where said gas spring automatically re-adjusts to a predetermined position, wherein said lever is adapted to be released from said locked position by removal of a downward force on said gas spring.

2. The height adjustable chair according to claim 1, wherein said delay mechanism further comprises a delay valve.

3. The height adjustable chair according to claim 1, wherein said delay mechanism further comprises a gas spring release.

4. The height adjustable chair according to claim 1, wherein said lever assembly is formed such that, once said lever is released from said locked position, movement of said lever from said locked position to said actuated position occurs over a time of about 5 minutes to about 60 minutes.

5. The height adjustable chair according to claim 1, wherein said lever assembly is formed such that, once said lever is released from said locked position, movement of said lever from said locked position to said actuated position occurs over a time of about 5 minutes to about 30 minutes.

6. The height adjustable chair according to claim 1, wherein said lever assembly further comprises a friction inducing component.

7. The height adjustable chair according to claim 1, wherein said lever assembly further comprises one or more springs.

* * * * *